United States Patent [19]

Wise

[11] Patent Number: 4,591,091

[45] Date of Patent: May 27, 1986

[54] ASEPTIC CONTAINER WITH TAMPER-RESISTANT SPOUT AND BLANK THEREFOR

[75] Inventor: Daniel J. Wise, Columbus, Ohio

[73] Assignee: Combibloc, Inc., Columbus, Ohio

[21] Appl. No.: 635,192

[22] Filed: Jul. 27, 1984

[51] Int. Cl.[4] ..... B65D 5/72

[52] U.S. Cl. ..... 229/17 G; 229/7 S; 229/DIG. 14

[58] Field of Search ..... 229/179, 75, DIG. 14

[56] References Cited

U.S. PATENT DOCUMENTS

| | | | |
|---|---|---|---|
| 3,127,082 | 3/1964 | Meyer-Jagenberg | 229/17 G |
| 3,178,091 | 4/1965 | Tobias et al. | 229/17 G |
| 3,186,621 | 6/1965 | Svensson | 229/17 G |
| 3,539,076 | 11/1970 | Weiss | 229/17 G |
| 3,770,185 | 11/1973 | Reeves | 229/17 G |
| 4,093,115 | 6/1978 | Bachner et al. | 229/17 G |
| 4,267,957 | 5/1981 | Holmstrom | 229/17 G |

*Primary Examiner*—Joseph Man-Fu Moy

*Attorney, Agent, or Firm*—Grover M. Myers

[57] ABSTRACT

A parallelepipedic aseptic container and a blank therefor formed of a multilayer paperboard laminate material are disclosed. The laminate material comprises a paperboard layer with a thin layer of polyethylene on the outer side thereof and a layer of metal foil disposed between thin layers of polyethylene on the inner side of the paperboard layer. The container blanks are formed such that at one of the container side walls, in an area covered by a folded portion of the top wall, a small pentagonally-shaped opening is partially or completely precut from the paperboard layer before it is laminated to the other layers to form a weakened portion that can be easily cut away to form a pouring opening. Scorelines are formed in the side wall adjacent the weakened portion to cause the wall to project outwardly to facilitate pouring liquids through the opening. A drinking straw/sutting implement is provided with the container for use in cutting away the weakened portion and withdrawing the contents of the container.

19 Claims, 7 Drawing Figures

FIG. 6
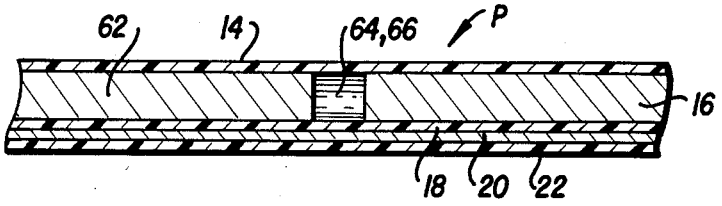
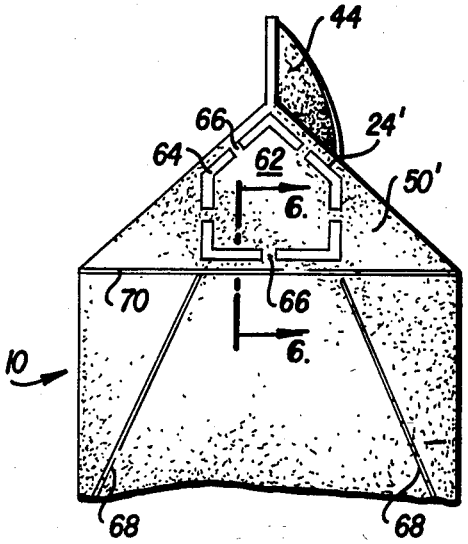
FIG. 5
FIG. 2
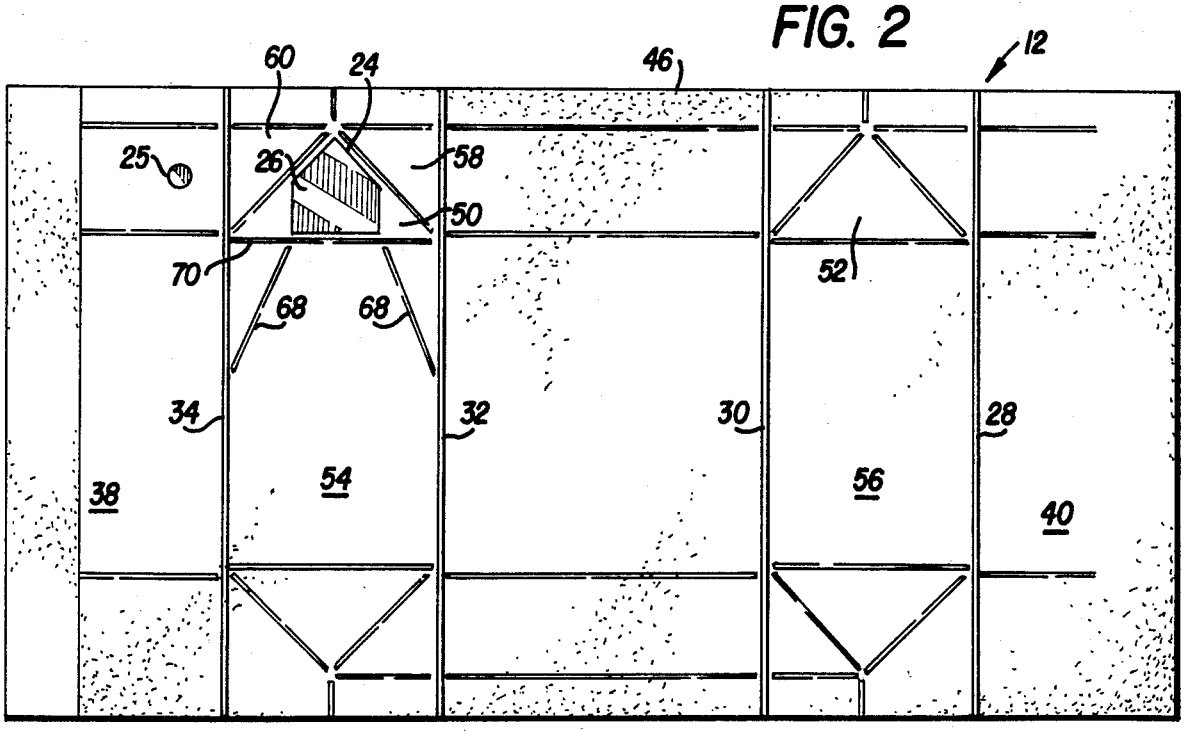

ASEPTIC CONTAINER WITH TAMPER-RESISTANT SPOUT AND BLANK THEREFOR

BACKGROUND OF THE INVENTION

The present invention relates to paperboard containers for liquids and blanks therefor and more particularly to aseptic containers for liquids having a pouring spout formed therein and an associated implement to open the pouring spout and withdraw the liquid contents of the container.

The term "aseptic" as used in the specification and claims herein in connection with a container or package is intended to include a gas- and liquid-tight container that is free of pathogenic organisms.

A search of the prior art failed to uncover any prior art references which disclose the aseptic container or blank of the present invention. A number of patents were uncovered which disclose liquid containers and blanks of varying design and complexity. The following is a list of the U.S. patents uncovered during the aforementioned search: U.S. Pat. Nos. 1,161,759; 3,981,430; 2,926,832; 4,101,051; 3,520,464; 4,171,064; 3,770,185; 4,244,474; 3,795,359; 4,294,362.

U.S. Pat. Nos. 3,795,359; 4,171,064; and 4,294,362 disclose parallelepipedic aseptic liquid containers or blanks therefor having a sealed seam along the top surface which is initially formed in a gable-top configuration and then folded down to form a substantially flat top surface. The containers disclosed in U.S. Pat. Nos. 3,795,359 and 4,294,362 are formed of a tough paperboard-foil-plastic laminate and are provided with tear lines in or across the sealed top seam of the containers which are intended to be torn or cut to provide a pouring spout. However, since the tear lines are provided in the double-wall thickness top seam adjacent the fused sealing line, it is frequently difficult to effect a tear of the tough laminate material, especially if the tear lines are not properly formed or aligned or if there is insufficient material to grasp to effect the tear of the seam. It is also sometimes necessary to use a scissors or other cutting implement to open the container.

U.S. Pat. Nos. 1,161,759 and 3,623,632 disclose paperboard containers for which drinking straws or pouring taps are utilized for withdrawing or pouring the contents from the containers.

The remaining patents listed above disclose other types of pouring spouts or tear strip openings of varying design and complexity for paperboard containers. However, the pouring spouts and tear strip openings for the containers disclosed in those patents are not particularly suitable for use with the paperboard laminate of conventional aseptic containers. Moreover, such spouts and openings are typically located in an exposed portion of the container and are thus subject to tampering.

SUMMARY AND OBJECTS OF THE INVENTION

In view of the foregoing limitations and shortcomings of the prior art containers as well as other disadvantages not specifically mentioned above, it should be apparent that there still exists a need in the art for an aseptic container for liquids or other fluent contents and a blank therefor, said container having a relatively tamper-proof, yet convenient and easily usable, spout or opening for pouring out the liquid or fluent contents thereof. It is, therefore, a primary objective of this invention to fulfill that need by providing an aseptic container formed of a blank of paperboard laminate and having a pouring spout formed by a weakened portion in the laminate in such manner that the aseptic characteristics of the container are maintained and the weakened portion is readily opened by the consumer yet is advantageously protected from tampering or other damage.

More particularly, it is an object of this invention to provide an aseptic container for fluent contents, said container being folded from a multilayer paperboard laminate blank which is provided with a weakened portion in the blank for forming an opening in the container, the weakened portion being completely covered by a folded portion of the container until the pouring spout is ready for use so as to protect the weakened portion from tampering or other damage and possible contamination of the contents.

Another object of this invention is to provide an aseptic paperboard container having a weakened portion in a wall thereof which can be easily opened to become a pouring spout, wherein the spout is shaped to provide air relief at the upper portion thereof and a relatively sharp pouring edge at the lower portion to minimize dripping.

Yet another object of the present invention is to provide a blank for an aseptic container formed of a multilayer laminate wherein a small area in one or more of the laminate layers has been precut to form a weakened portion in the container wall that can be readily removed to form a pouring spout for the liquid in the container.

Another object of the invention is to provide, in combination with an aseptic container, a versatile implement removably secured to the exterior of the container which can be used as a cutting tool to aid in opening a preformed pouring spout in a wall of the container and as a drinking straw to withdraw the contents of the container.

Briefly described, the aforementioned objects are accomplished according to the invention by providing a parallelepipedic aseptic container or a blank therefor comprising a multilayer laminate material. The laminate material comprises a paperboard sheet with a thin layer of polyethylene formed on each side thereof, a layer of metal foil laminated to the layer of polyethylene on one side of the paperboard sheet, and another layer of polyethylene laminated to the foil.

The container blank is first folded to form a rectangular tube and then sealed along the overlapping edges in a conventional manner. After one end of the tube is sealed to form the bottom, the contents are aseptically introduced into the container. A fillet seam is then formed and sealed along the top of the container and folded down onto the top wall surfaces and over a portion of each of the narrow side walls of the container and sealed thereto.

A small pentagonal-shaped opening is completely or partially precut from the paperboard layer before it is laminated to the foil and polyethylene layers to thereby create a weakened portion of the container that can be easily cut away to form a pouring spout or opening. Scorelines are formed in the narrow side wall adjacent the weakened portion to cause the wall to be projected outwardly to form a relatively sharp pouring edge or lip to thereby facilitate pouring the fluent contents from the container without dripping. When the container blank is folded, an end portion of the top sealed seam, which is folded over the narrow side walls of the container, overlies and covers the weakened portion so as to protect the same from tampering or damage.

The container is also provided with means for carrying a removable drinking straw, one end of which is flattened or pointed to form a knife-like cutting implement for cutting through the foil and polyethylene layers of the weakened portion of the paperboard laminate material to form the pouring spout of the container.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 2 is a plan view of a blank of the present invention used for forming the aseptic container of FIG. 1;

FIG. 5 is a fragmentary side elevation view of the side wall of the container of the present invention showing an alternative embodiment of the pouring spout;

FIG. 6 is a fragmentary cross-sectional view of the alternative embodiment of the pouring spout weakened portion taken along line 6—6 of FIG. 5.

DETAILED DESCRIPTION OF A PREFERRED EMBODIMENT

Figure 1:
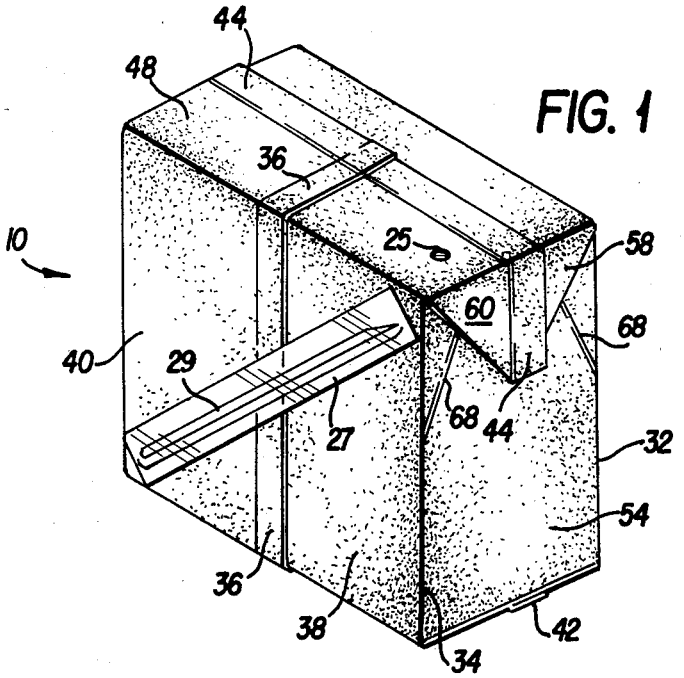
FIG. 1 is a perspective view of an aseptic container of the present invention shown in its sealed condition in combination with a drinking straw/knife implement.
Figure 4:
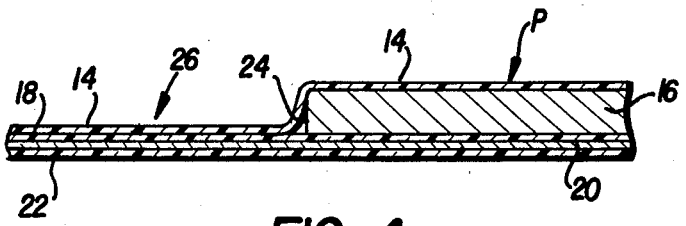
FIG. 4 is a fragmentary cross-sectional view of the pouring spout weakened portion taken along line 4—4 of FIG. 3.

Referring now in detail to the drawings wherein like elements are designated by like reference numerals throughout, there is illustrated in FIGS. 1 and 2 respectively, an aseptic container 10 according to the present invention and a blank 12 formed of a conventional multilayer paperboard laminate P, a cross-section of which is illustrated in FIG. 4.

The outermost layer 14 of the container laminate material is preferably a thin transparent polyethylene sheet. Adjacent the polyethylene layer 14 is a somewhat thicker layer 16 of opaque paperboard material which may have printing and other indicia on the outermost side thereof confronting the transparent polyethylene layer 14. Laminated to the inner side (i.e., the lower side as seen in FIG. 4) of the paperboard layer 16 is another layer 18 of polyethylene sheet to which is laminated a layer of impervious metal foil 20. Another thin layer 22 of polyethylene sheet is laminated to the foil layer 20 on the bottom side of the container laminate, i.e., the side which forms the inside walls of the container.

Prior to lamination of the layers of polyethylene to the paperboard layer 16, a polygonal opening 24 (FIG. 2), preferably in the shape of an irregular pentagon as shown, is die cut or punched from the paperboard layer 16 in one of the narrow side panels as described in further detail hereinbelow. Alternatively, the opening 24 may be cut after the lamination of the first layer 14 of polyethylene to the paperboard layer 16 and prior to the lamination of the paperboard layer 16 to the foil and polyethylene layers 18, 20, 22. After the layers 14, 16, 18, 20, 22 are laminated together to form a continuous sheet or web of laminate, a plurality of container blanks 12 are cut from the multilayer laminate web material and provided with fold lines as shown in dashed lines in FIG. 2. The precut opening 24 in the paperboard layer 16 exposes a small area 26 of the foil layer covered by the double thickness of polyethylene layers 14, 18. FIG. 4 shows a cross section of the multilayer laminate material taken through a portion of the opening 24 in the paperboard layer 16.

To construct the container 10 from the blank 12, the blank is folded along fold lines 28, 30, 32, 34 to form a generally rectangular tube. A sealed seam 36 is formed in a conventional manner so as to extend vertically along the free edges of side panels 38, 40. After the seam 36 has been sealed, the bottom of the blank 12 is folded and sealed in a conventional manner, such as that disclosed in U.S. Pat. No. 3,998,378, the disclosure of which is incorporated herein by reference. Folding the blank according to that method results in the formation of a rectangularly-shaped bottom with inwardly folded gable end walls tucked beneath the bottom flaps, which are seamed together, folded flat and sealed to the bottom of the container as shown at reference numeral 42.

A third sealed seam 44 is also formed in a conventional manner, after the container has been aseptically filled, by sealing together the upstanding free ends of the container side walls corresponding to edge 46 of the blank 12. Seam 44 is then folded flat to form the top panel 48 of the container 10. At each end of the seam 44 there is formed a triangular flap 50, 52, which is folded down onto and heat sealed to a respective narrow side wall 54, 56 to form a generally parallelepipedic container. The filled container is thus ready for shipping or storage.

When the container blank 12 is folded and sealed to form the container 10, the foil area 26, exposed by the precut opening 24, is located on the triangular panel 50 between side wall 54 and panels 58, 60. When the triangular flap 50 is folded down as shown in FIG. 1, the foil area 26 is interposed between side wall 54 and seam 44 and panels 58, 60, where it is thus protected from tampering and damage.

A straw hole 25 may optionally be located on the top surface 48 of the container. In a manner similar to the foil area 26, the straw hole 25 may be precut from the paperboard layer to create a weakened area comprising only the foil and polyethylene layers.

Affixed to a side wall of the container 10 by means of a peelable strip 27 or other suitable fastening means is an implement 29 comprising a drinking straw having a flattened, knife-like or pointed end 31. The implement 29 can be used to puncture the foil in the straw hole 25 or as a cutting implement to remove the foil area 26 from the triangular panel 50 and expose the pentagonal pouring spout of the container. The implement 29 can also be used as a drinking straw to withdraw the contents of the container 10 from either the straw hole 25 or the pouring spout as desired.

In an alternative embodiment shown in FIGS. 5 and 6, the paperboard layer is not completely cut out from the opening 24', but rather is only partially cut out leaving a pentagonal paperboard panel 62 in the opening 24' of triangular panel 50'. A small gap 64 of about 0.5 to 1.0 millimeters in width extends about the perimeter of the panel 62 and is retained in position by uncut portions or connecting paperboard tabs 66 to provide further protection for the foil and polyethylene layers 18, 20, 22 beneath the panel 62. The connecting tabs 66 are preferably located approximately at the mid-point of each side of the pentagonally-shaped weakened portion of the container.

Figure 7:
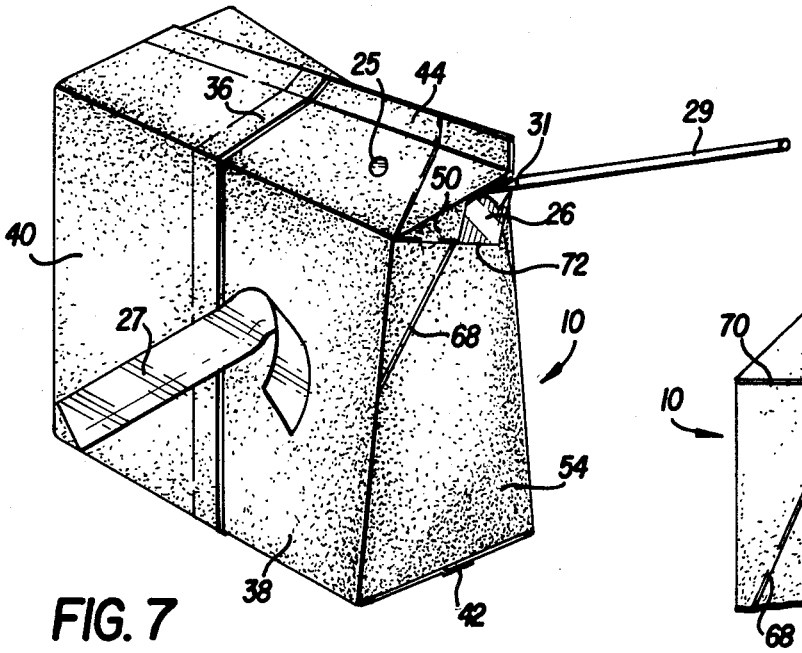
FIG. 7 is a perspective view of a container of the present invention illustrating the manner in which the pouring spout is exposed for cutting with the drinking straw/knife implement.
Figure 3:
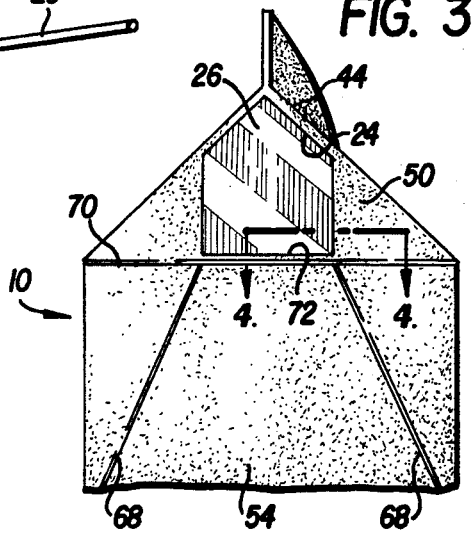
FIG. 3 is a fragmentary side elevation view of the side wall of the container showing the weakened portion for forming the pouring spout.

To access the pouring spout, the flap formed by panels 58, 60 is grasped at the end of seam 44, pulled away from side wall 54 and folded upwardly into the position shown in FIG. 7. The foil panel 26, or in the case of the FIG. 5 embodiment, the cardboard panel 62, together with the underlying foil panel 26, is cut away with the pointed end 31 of the implement 29 as shown in FIG. 7. Diagonal score lines 68 extend between horizontal fold line 70 adjacent the bottom edge 72 of opening 24 to allow the end panel 54 and thus the bottom edge 72 of opening 24 to project outwardly from the container. The straight cut of edge 72 allows the liquid contents of the container to be poured over a sharp edge wth a minimum of dripping. The angular top of the pentagonal opening adjacent seam 44 allows air to pass over the top of the liquid flow to relieve any back pressure and assure a steady stream or flow of liquid from the container.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A paperboard container for fluent contents formed of a multilayer laminate material having a paperboard layer and a metal foil layer, said container comprising:

a bottom, a top and four side walls formed in the shape of a parallelepiped;

a sealed seam formed along the top of said container, at least one end of said seam being foldable onto one of said sidewalls of said container;

a panel extending from said one side wall, said panel having a geometrically-shaped weakened portion comprising an opening disposed only in the paperboard layer of said laminate material, the foil layer of said multilayer laminate material confronting and surrounding the opening being intact and imperforate, said weakened portion being covered when said seam is folded onto said one side wall.

2. A container according to claim 1, wherein said container is formed of a multilayer laminate material comprising a paperboard layer, a metal foil layer, and a plurality of plastic layers.

3. A container according to claim 1, further comprising diagonal score means formed in said side wall adjacent said weakened portion for projecting said panel outwardly to facilitate pouring the fluent contents from the opening.

4. A container according to claim 1, wherein the geometric shape of the weakened portion comprises a pentagon, one side of which forms a straight pouring edge and one included angle of which forms an air relief opening in the container.

5. A container according to claim 1, wherein said laminate material further comprises plastic layers disposed on both sides of said metal foil and paperboard layers.

6. A container according to claim 1, wherein said laminate material further comprises at least one plastic layer.

7. A container according to claim 1, including an implement removably affixed to the container for cutting through the laminate material in said weakened portion to form an opening in said container.

8. A container according to claim 7, wherein said implement comprises a drinking straw having means thereon for cutting through said laminate material.

9. A container according to claim 1, wherein said panel is triangular in shape, said triangularly-shaped panel being connected to said one side wall along a fold line, an apex of said triangularly-shaped panel being disposed opposite said fold line and adjacent said sealed seam.

10. A carton blank formed of a multilayer laminate material comprising a paperboard layer and a metal foil layer adapted to be folded into a parallelepiped-shaped container for fluent contents, said blank comprising a plurality of side wall panels hingedly interconnected by fold lines, a bottom end closure panel hingedly connected by fold lines to one end of said side wall panels, and a top end closure panel hingedly connected by fold lines to the other end of said side wall panels, said top end closure panel having a geometrically-shaped weakened portion comprising an opening disposed only in the paperboard layer of said laminate material, the foil layer of said laminate material confronting and surrounding the opening being intact and imperforate, the geometrically-shaped weakened portion being covered by portions of said top end closure panel when said blank is folded into a container.

11. A carton blank according to claim 10, wherein said blank is formed of a multilayer laminate comprising a paperboard layer, a metal foil layer, and a plurality of plastic layers.

12. A carton blank according to claim 10, wherein the geometric shape of said weakened portion is a pentagon.

13. A carton blank according to claim 10, further comprising diagonal score lines formed in one of said side wall panels adjacent said weakened portion.

14. A carbon blank according to claim 10, wherein said laminate material further comprises plastic layers disposed on both sides of said metal foil and paperboard layers.

15. A carbon blank according to claim 10, wherein said laminate material further comprises at least one plastic layer.

16. A carbon blank according to claim 10, wherein said top end closure panel includes a triangularly-shaped panel connected to one of said side wall panels along a fold line, an apex of said triangularly-shaped panel being disposed opposite said fold line.

17. A container according to claim 9, wherein said weakened portion is pentagonally-shaped, three sides of said pentagonally-shaped weakened portion being parallel to and spaced from three respective sides of said triangularly-shaped panel.

18. A carton blank according to claim 16, wherein the geometric shape of the weakened portion comprises a pentagon, one side of which forms a straight edge parallel to the fold line between the top end closure panel and the side wall panels, one included angle of said pentagon being disposed opposite said one side of the pentagon adjacent an apex of the triangularly-shaped panel.

19. A carbon blank according to claim 16, wherein said weakened portion is pentagonally-shaped, three sides of said pentagonally-shaped weakened portion being parallel to and spaced from three respective sides of said triangularly-shaped panel.

* * * * *